US011725470B1

(12) United States Patent
Otaif et al.

(10) Patent No.: US 11,725,470 B1
(45) Date of Patent: Aug. 15, 2023

(54) INVERTED TAPERED OVERSHOT

(71) Applicant: SAUDI ARABIAN OIL COMPANY, Dhahran (SA)

(72) Inventors: Hassan Wafi Otaif, Dhahran (SA); Ibrahim A. Ghamdi, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 17/682,883

(22) Filed: Feb. 28, 2022

(51) Int. Cl.
*E21B 31/18* (2006.01)
*E21B 17/042* (2006.01)

(52) U.S. Cl.
CPC ..... *E21B 31/18* (2013.01); *E21B 17/042* (2013.01)

(58) Field of Classification Search
CPC ..... E21B 17/042; E21B 31/18
See application file for complete search history.

(56) References Cited

U.S. PATENT DOCUMENTS 1,381,529 A * 6/1921 Whitmer ..... E21B 31/18 285/322
2,174,077 A * 9/1939 Bowen ..... E21B 31/18 294/86.17
2,218,337 A * 10/1940 Mallory ..... E21B 31/18 294/86.13
2,553,985 A * 5/1951 Siracusa ..... E21B 31/18 294/86.13
5,409,065 A 4/1995 Davis
5,865,253 A * 2/1999 Gamper ..... E21B 31/18 166/301
7,083,209 B2 8/2006 Leman et al.
2014/0069649 A1 3/2014 Streater, Jr. et al.

FOREIGN PATENT DOCUMENTS

CN 209818002 U 12/2019
WO 2014/074754 A2 5/2014

OTHER PUBLICATIONS

Inglis, T.A.; "Drilling problems in directional wells" Springer, Dordrecht, 1987 pp. 172-195 (24 pages).

* cited by examiner

*Primary Examiner* — Christopher J Sebesta
(74) *Attorney, Agent, or Firm* — Osha Bergman Watanabe & Burton LLP

(57) ABSTRACT

An overshot for removing a fish from a wellbore includes a first catch that attaches to a fishing assembly and one or more additional catches that connect, in sequence, to the first catch. Each catch of the one or more additional catches includes a different internal diameter from other catches of the one or more additional catches. The one or more additional catches are connected, in order, according to their respective internal diameters. The overshot attaches to a top of the fish.

13 Claims, 10 Drawing Sheets

INVERTED TAPERED OVERSHOT

BACKGROUND

In the oil and gas industry, hydrocarbon fluids are commonly found in hydrocarbon reservoirs. These hydrocarbon reservoirs are located far below the surface of the earth in porous rock formations. In order to access the hydrocarbon fluids, wells are drilled into the formations. While drilling the well or during daily operations of the well, equipment or junk often becomes lost or lodged within the well and is referred to as a fish.

Typically, regular drill bits cannot drill through fish. Should a fish fall into a well, a "fishing job" is required to remove the fish from the well, or otherwise clear the well of the fish. Common fishing jobs include pulling the fish out of the well by operating fishing tools that latch onto the fish or milling the fish to clear the well with the use of high strength milling tools.

When employing fishing tools, most fishing tools are screwed into the end of a fishing string or drill string and lowered into the well. The fishing tool may be an overshot, a tool which functions by surrounding the fish and gripping it from the outside. The grip is strong enough to carry the fish up the wellbore to the surface.

SUMMARY

An overshot for removing a fish from a wellbore includes a first catch that attaches to a fishing assembly and one or more additional catches that connect, in sequence, to the first catch. Each catch of the one or more additional catches includes a different internal diameter from other catches of the one or more additional catches. The one or more additional catches are connected, in order, according to their respective internal diameters. The overshot attaches to a top of the fish.

A method for removing a fish from a wellbore with an overshot includes attaching a first catch of the overshot to a fishing assembly, connecting one or more additional catches of the overshot to the first catch in sequential order according to their respective internal diameters, and attaching the overshot to a top of the fish. Each catch of the one or more additional catches includes a different internal diameter from other catches of the one or more additional catches.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility.

DETAILED DESCRIPTION

Specific embodiments of the disclosure will now be described in detail with reference to the accompanying figures. In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well known features have not been described in detail to avoid unnecessarily complicating the description.

Throughout the application, ordinal numbers (e.g., first, second, third, etc.) may be used as an adjective for an element (i.e., any noun in the application). The use of ordinal numbers is not intended to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

In addition, throughout the application, the terms "upper" and "lower" may be used to describe the position of an element in a well. In this respect, the term "upper" denotes an element disposed closer to the surface of the Earth than a corresponding "lower" element when in a downhole position, while the term "lower" conversely describes an element disposed further away from the surface of the well than a corresponding "upper" element. Likewise, the term "axial" refers to an orientation substantially parallel to the well, while the term "radial" refers to an orientation orthogonal to the well.

This disclosure describes systems and methods of removing a fish from a wellbore using a spiral grapple overshot that includes multiple, attachable catches of varying internal diameters. The techniques discussed in this disclosure are beneficial in avoiding multiple trial and error fishing runs.

Figure 1:
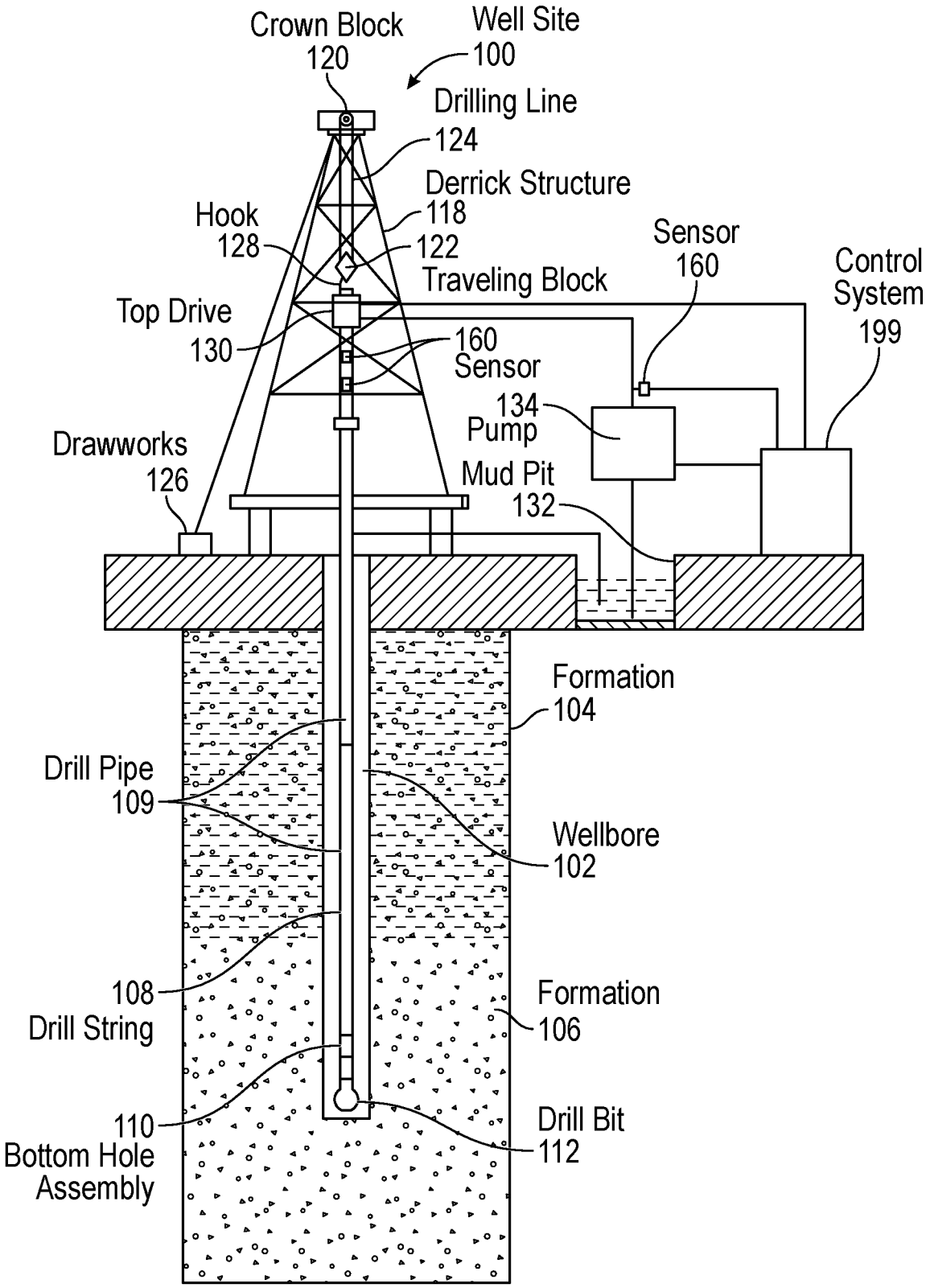
FIG. 1 shows an exemplary well site in accordance with one or more embodiments of the present disclosure.

FIG. 1 illustrates an exemplary well site (100). In general, well sites (100) may be configured in a several different ways. Therefore, the illustrated well site (100) of FIG. 1 is not intended to be limiting with respect to the particular configuration of the drilling equipment. The well site (100) is depicted as being on land. In other examples, the well site (100) is located offshore, and a marine riser is utilized for drilling. In this example, a drilling operation at well site (100) includes drilling a wellbore (102) into a subsurface including various formations (104, 106). A drill string (108) is suspended within the wellbore (102) for the purpose of drilling a new section of wellbore (102).

The drill string (108) is made of several steel drill pipes (109) connected to form a conduit. Situated at the distal end of the conduit is a bottom hole assembly (BHA) (110). The BHA (110) includes a drill bit (112) for cutting into the various formations (104, 106). In addition, the BHA (110) may also include measurement tools that have sensors (160) and hardware to measure downhole drilling parameters, and these measurements may be transmitted to the surface using any suitable telemetry system known in the art. Further, the BHA (110) and the drill string (108) may include other drilling tools known in the art but not specifically shown.

The drill string (108) is suspended in the wellbore (102) by a derrick structure (118).

Mounted at the top of the derrick structure (118) is a crown block (120). A traveling block (122) hangs down from the crown block (120) via a drilling line (124). Connected to one end of the drilling line (124) is a drawworks (126). The drawworks (126) is a reeling device used to adjust the length of the drilling line (124) so that the traveling block (122) is capable of moving up or down the derrick structure (118). Additionally, the traveling block (122) includes a hook (128) on which a top drive (130) is supported.

The top drive (130) is coupled to the top of the drill string (108) in order to rotate the drill string (108). During a drilling operation at the well site (100), subsurface rock is broken by rotating the drill string (108) relative to the wellbore (102) and applying weight to the drill bit (112). Drilling fluid (often referred to as mud) is stored in a mud pit (132), and at least one pump (134) may pump the mud from the mud pit (132) into the drill string (108). The mud flows into the drill string (108) through appropriate flow paths in the top drive (130). Details of the mud flow path have been omitted for simplicity but would be understood by a person skilled in the art.

Here, a control system (199) is disposed at and communicates with the well site (100). The control system (199) controls at least a portion of a drilling operation at the well site (100) by providing commands to various components of the drilling operation. The control system (199) is capable of receiving data from one or more sensors (160) arranged to measure controllable parameters of the drilling operation. Sensors (160) may be arranged to measure WOB (weight on bit), RPM (drill string (108) rotational speed), GPM (flow rate of the mud pumps (134)), ROP (rate of penetration of the drilling operation), and other measurements that might be appropriate and understood by a person skilled in the art.

While drilling the wellbore (102), as described above, various pieces of equipment may become disconnected or fall from the surface portion of the well site (100) (surface portion being on or above the surface of the Earth) and become lost in the downhole portion of the well site (100) (downhole portion being anywhere beneath the surface of the Earth). Equipment or junk that is lost or lodged downhole is called a fish (203). Commonly, a fish (203) originates from a drilling operation as described above, such as the drill bit (112) or a portion of the drill string (108), but may be any other operation equipment without departing from the scope of this disclosure.

The fish (203) may be fished or drilled out to clear the well for production and/or continuing operations. For a fishing job to be successful, the fishing tool must engage the top of the fish (219), or the accessible portion of the fish (203), with enough force to pull the fish (203) out of the well. However, in many instances, the shape of the top of the fish (219) is ambiguous or otherwise unknown, such that engaging the fish (203) is difficult, time-consuming, and oftentimes requires multiple trial and error runs to use the correct size of fishing tool.

One option for removing the fish (203) and continuing operations includes drilling the fish (203) out of the well using a mill bit. A mill is designed to drill through tougher materials, such as steel, when compared to a conventional drill bit (112). Mills are available in a plurality of different mill shapes depending on the shape of the fish (203). However, because it is difficult to know the shape of the fish (203) and its orientation while the fish (203) is downhole, the wrong mill shape may be selected resulting in a failed fishing job and additional costs, in both time and money. Due to the difficulties associated with milling a fish (203), a fishing tool that can successfully remove or otherwise clear the well of the fish (203) regardless of the shape and orientation of the fish (203) is beneficial. Accordingly, embodiments disclosed herein present systems and methods for an inverted tapered overshot (201) tool used to remove a fish (203) disposed downhole in a wellbore (102) in a single trip, without the knowledge of the dimensions of the fish (203).

Figure 2:
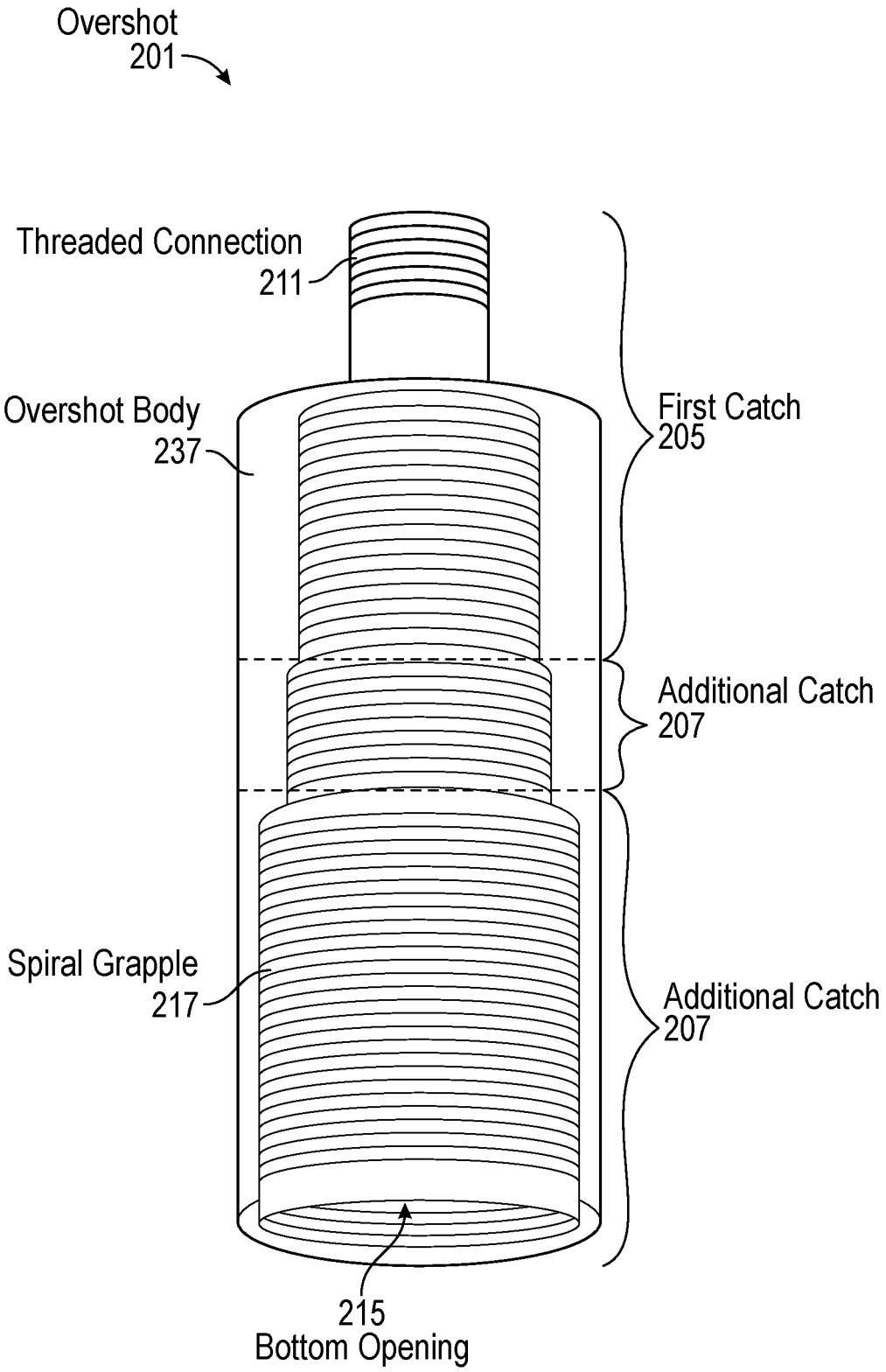
FIG. 2 shows a cross-sectional view of an overshot in accordance with one or more embodiments of the present disclosure.

FIG. 2 shows a cross-sectional view of an overshot (201) in accordance with one or more embodiments of the present disclosure. Here, the overshot (201) includes a first catch (205) with a plurality of additional catches (207) attached to it at the downhole end. Disposed at a first end (209) of the first catch (205) is a threaded connection (211) that connects the overshot (201) to a fishing assembly (213). The additional catches (207) are connected to the first catch (205) and each other in an inverted tapered order. The additional catch (207) closest to the end of the wellbore (102) swallows the fish (203) through a bottom opening (215). The fish (203) passes through each additional catch (207) until it reaches a catch with an internal diameter smaller than its diameter, thereby preventing the fish (203) from traveling further up in the overshot (201). The interiors of each additional catch (207) and the first catch (205) include separate spiral grapples (217) configured to secure the top of the fish (219) within the overshot (201). The additional catches (207) can vary in length. However, each additional catch (207) and the first catch (205) share a same exterior diameter.

By way of the nonlimiting example, and as shown in FIG. 2, the number of additional catches (207) commonly attached to the first catch (205) may be two or three. However, further additional catches (207) may be attached to the overshot (201) depending on the difficulty of determining the dimensions of the top of the fish (219).

Figure 3:
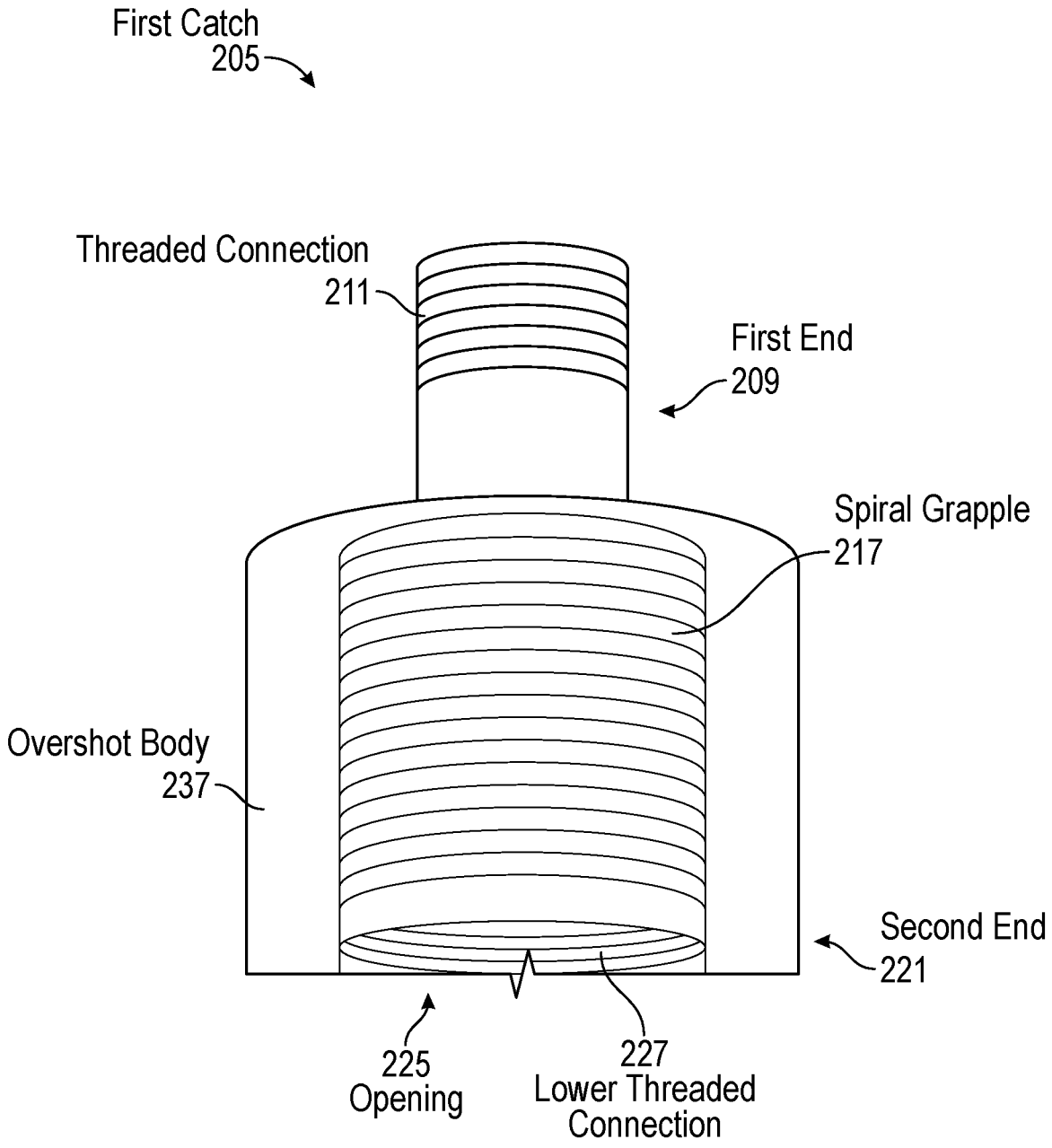
FIG. 3 shows a cross-sectional view of a first catch in accordance with one or more embodiments of the present disclosure.

FIG. 3 shows a cross-sectional view of a first catch (205) in accordance with one or more embodiments of the present disclosure. The first catch (205), formed of steel, is employed to connect to the fishing assembly (213) at a first end (209) and to additional catches (207) at a second end (221). The fishing assembly (213) is made up of the drill string (108) and a sub (223). The sub (223) is a threaded connection piece, formed of steel, that connects the drill string (108) and the first catch (205). The first catch (205) attaches to the sub (223) by a threaded connection (211) disposed at the first end (209) of the first catch (205). The threaded connection (211) attaches to the interior of the sub (223) in this particular embodiment. In additional embodiments, the threaded connection (211) attaches to the exterior of the sub (223).

At the second end (221) of the first catch (205) is an opening (225) configured to swallow the fish (203). Additionally, the opening (225) allows for additional catches (207) to be attached to the first catch (205). The internal diameter of the first catch (205) is the smallest internal diameter of all the of all the catches. Within the first catch (205), disposed at the opening (225), is a lower threaded connection (227) configured to connect the first catch (205) with additional catches (207). In this particular embodiment the lower threaded connection (227) is situated within the interior of the first catch (205). However, in additional embodiments, the lower threaded connection (227) is situated on the exterior of the first catch (205).

The interior of the first catch (205) and additional catches (207) are made up of separate spiral grapples (217). A spiral grapple (217) is a steel gripping mechanism utilized to secure the top of the fish (219) within the overshot (201). The spiral grapple (217) is designed as a left-hand coil with a tapered exterior to conform with a helically tapered section in the interior of the first catch (205) and additional catches (207). The interior of the first catch (205) and additional catches (207) are wickered for engagement with the fish (203). The spiral grapple (217) engages the fish (203) by rotating over the fish (203) in a specific direction, and, when an upward pull load is applied, the grapple bites into the fish (203) to form a grip that may pull the fish (203) from the wellbore (102).

Figure 4:
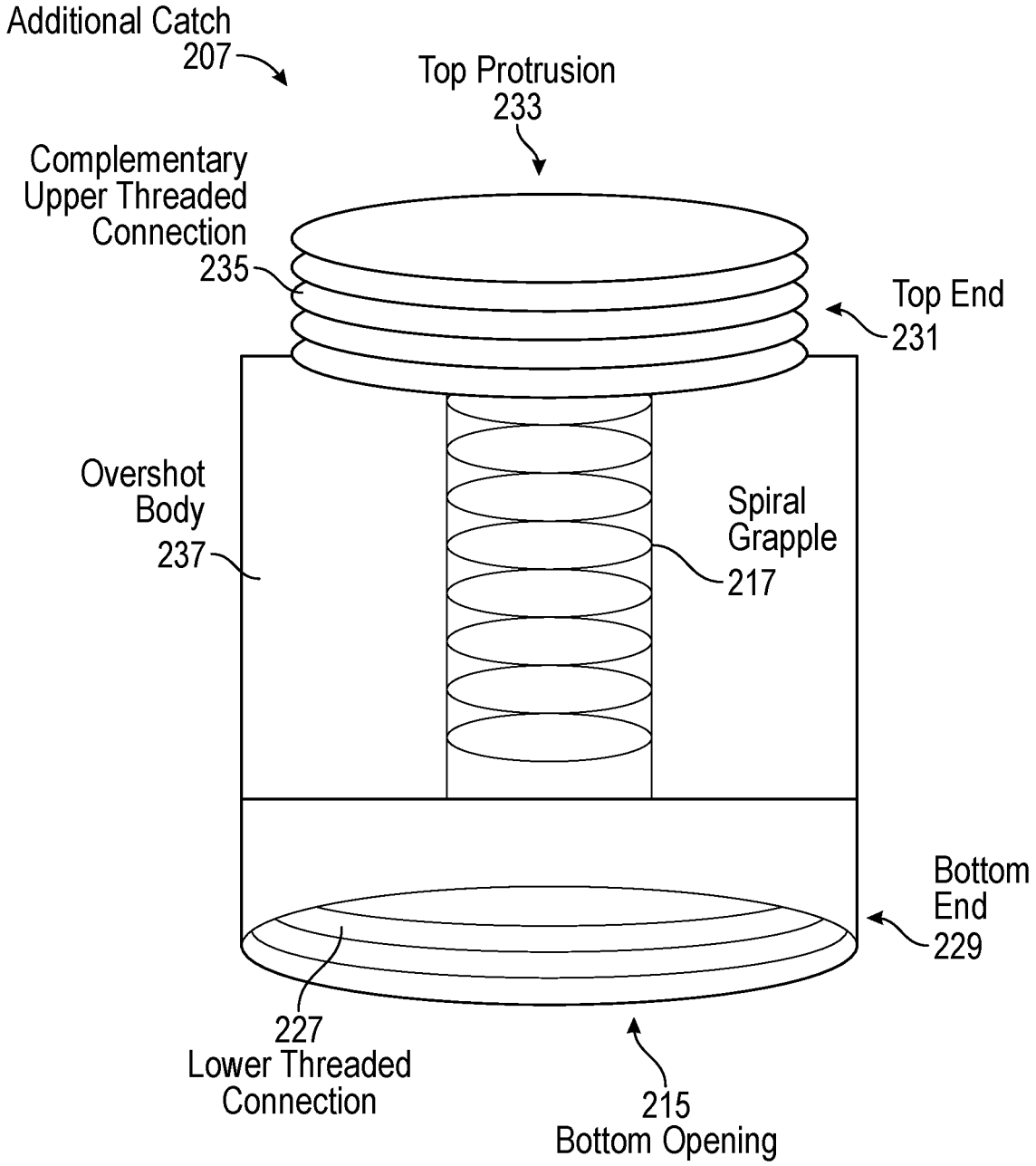
FIG. 4 shows an additional catch in accordance with one or more embodiments of the present disclosure.

FIG. 4 shows an example additional catch (207) in accordance with one or more embodiments of the present disclosure. The additional catch (207) of FIG. 4 4 includes an internal diameter that is larger than the internal diameter of the first catch (205). Each additional catch (207) is formed of steel and includes a bottom opening (215) disposed at a bottom end (229). The bottom opening (215) enables the additional catch (207) to swallow a fish (203) and also includes a lower threaded connection (227). The lower threaded connection (227) enables an additional catch (207) with a larger internal diameter to be connected to this particular additional catch (207). In this embodiment, the lower threaded connection (227) is situated within the interior of the additional catch (207). However, in other embodiments, the lower threaded connection (227) is situated on the exterior of the first catch (205).

At a top end (231) of the additional catch (207) is a top protrusion (233). The top protrusion (233) allows for the fish (203) to pass through the additional catch (207) into the first catch (205) if the internal diameter of the additional catch (207) is greater than the diameter of the fish (203). Further, disposed at the top end (231) is a complementary upper threaded connection (235) that connects with the lower threaded connection (227) of the first catch (205) or the lower threaded connection (227) of an additional catch (207). In this embodiment, the complementary upper threaded connection (235) is situated on the exterior of the additional catch (207). However, in other embodiments, the complementary upper threaded connection (235) is situated on the interior of the additional catch (207).

In this embodiment, the complementary upper threaded connection (235) has a diameter slightly less than the diameter of the lower threaded connection (227) such that it fits inside the lower threaded connection (227) when connected. Additionally, the lower threaded connection (227) and the complementary upper threaded connection (235) are the same size on each additional catch (207). In this way, if the dimensions of the top of the fish (219) are known, not every additional catch (207) with a smaller internal diameter has to be attached to the first catch (205) before the additional catch (207) with the required internal diameter is attached.

As mentioned above, the internal diameter of this particular additional catch (207) is slightly larger than the internal diameter of the first catch (205). However, the first catch (205) and the additional catch (207) both have a same exterior diameter. In this way, the first catch (205) and the additional catch (207) form a tube with the same exterior diameter, but with a tapered interior.

Figure 5:
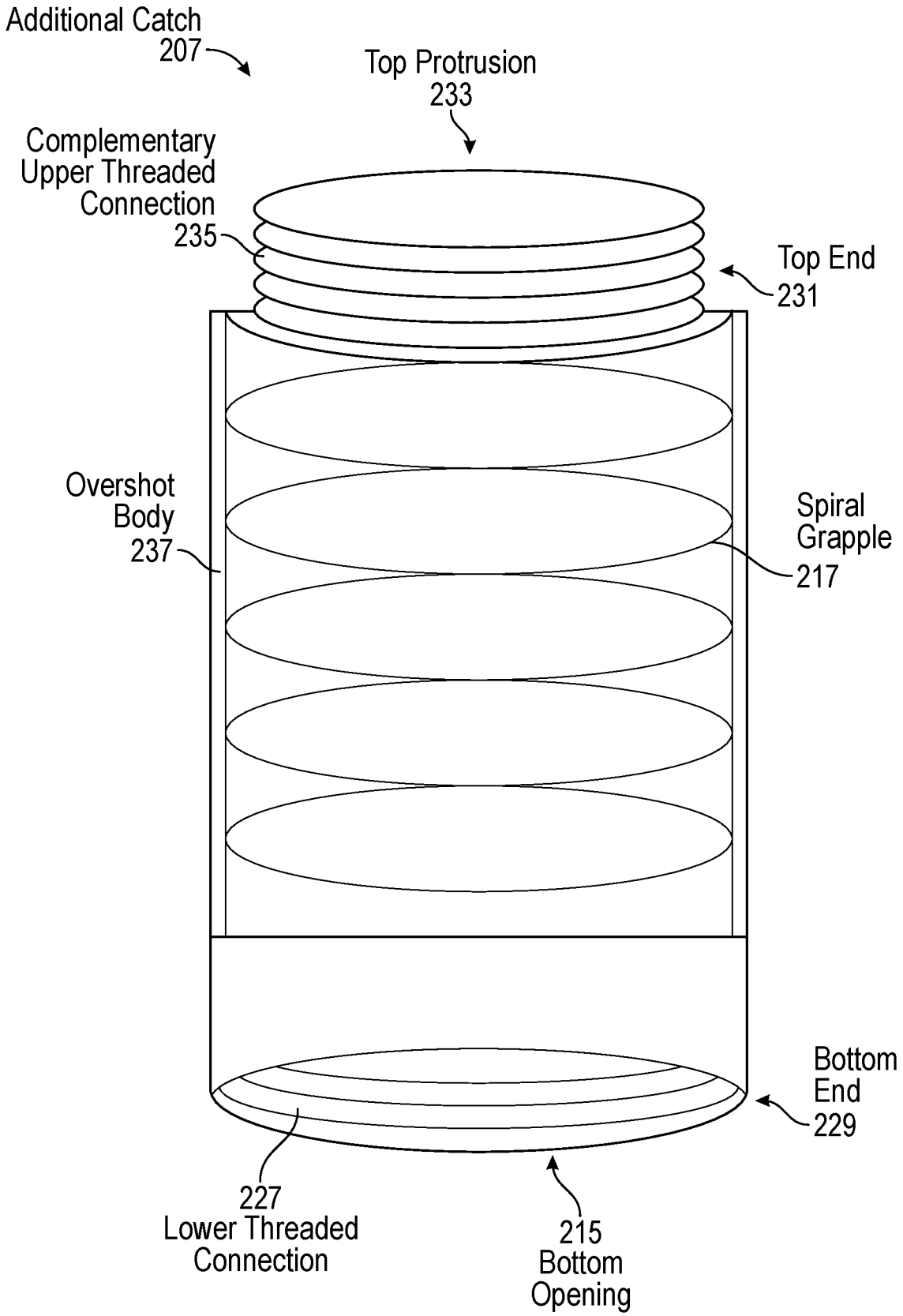
FIG. 5 shows an additional catch in accordance with one or more embodiments of the present disclosure.

FIG. 5 also shows an example additional catch (207) in accordance with one or more embodiments of the present disclosure. This particular additional catch (207) includes an internal diameter much larger than the internal diameter of the first catch (205) and the additional catch (207) of FIG. 4. Similar to the additional catch (207) seen in FIG. 4, at a bottom end (229) of this additional catch (207) is a bottom opening (215) and a lower threaded connection (227). At the top end (231) of the additional catch (207) is a top protrusion (233) and a complementary upper threaded connection (235). This additional catch (207) may be connected to the second end (221) of first catch (205) or to the lower end of an additional catch (207) that has a smaller internal diameter. While the internal diameter is much larger than the internal diameter of the first catch (205), the exterior the first catch (205) and this additional catch (207) still both have the same exterior diameter.

In addition, each additional catch (207) has a different width of an overshot body (237). Since additional catches (207) have different internal diameters but the same exterior diameter, the overshot body (237), the space between the exterior diameter and the interior diameter, is a different width for each additional catch (207). The overshot body (237) may be an empty space between an exterior wall and an interior wall of the additional catch (207) or a solid material such as steel.

Figure 6:
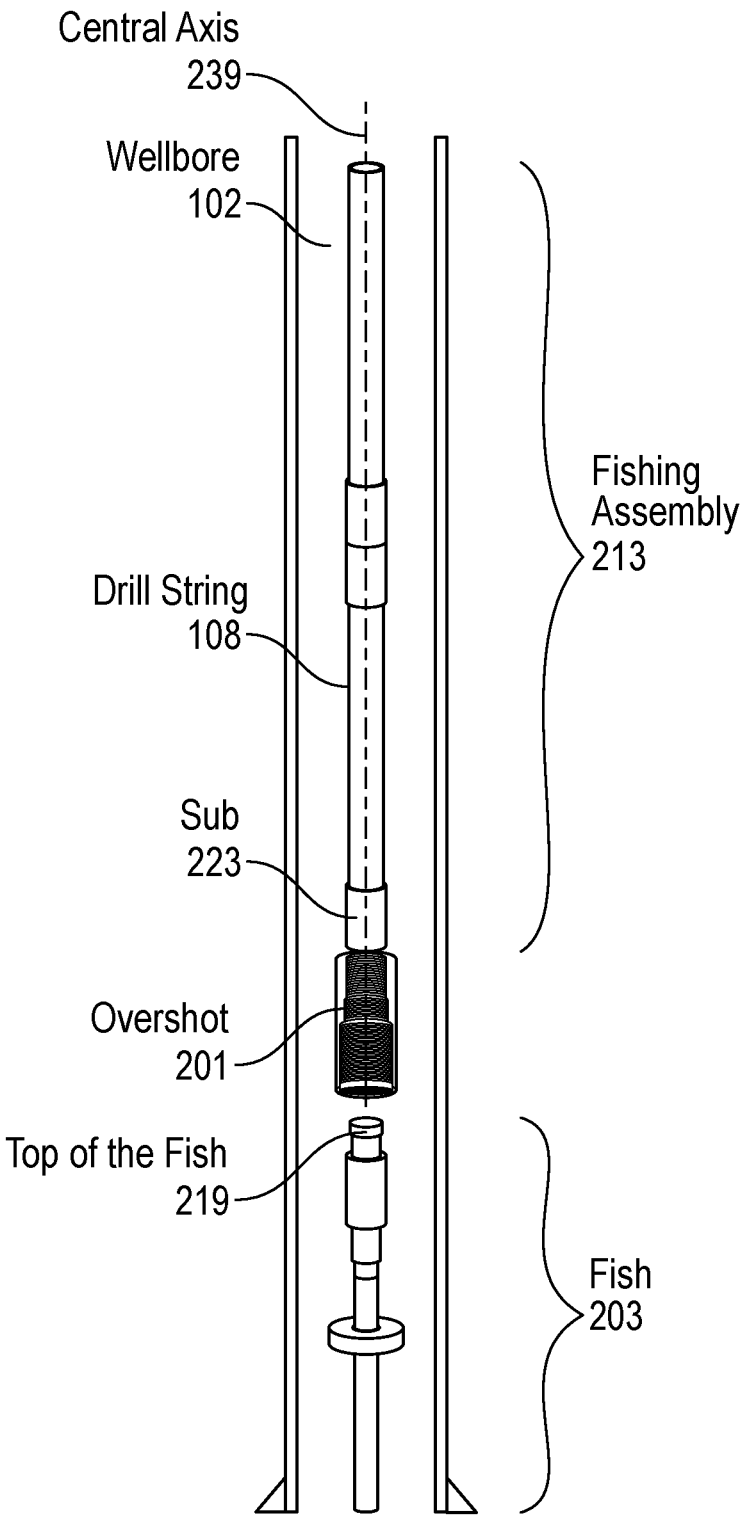
FIGS. 6 and 7 show diagrams depicting the operational sequence of the system in accordance with one or more embodiments.
Figure 7:
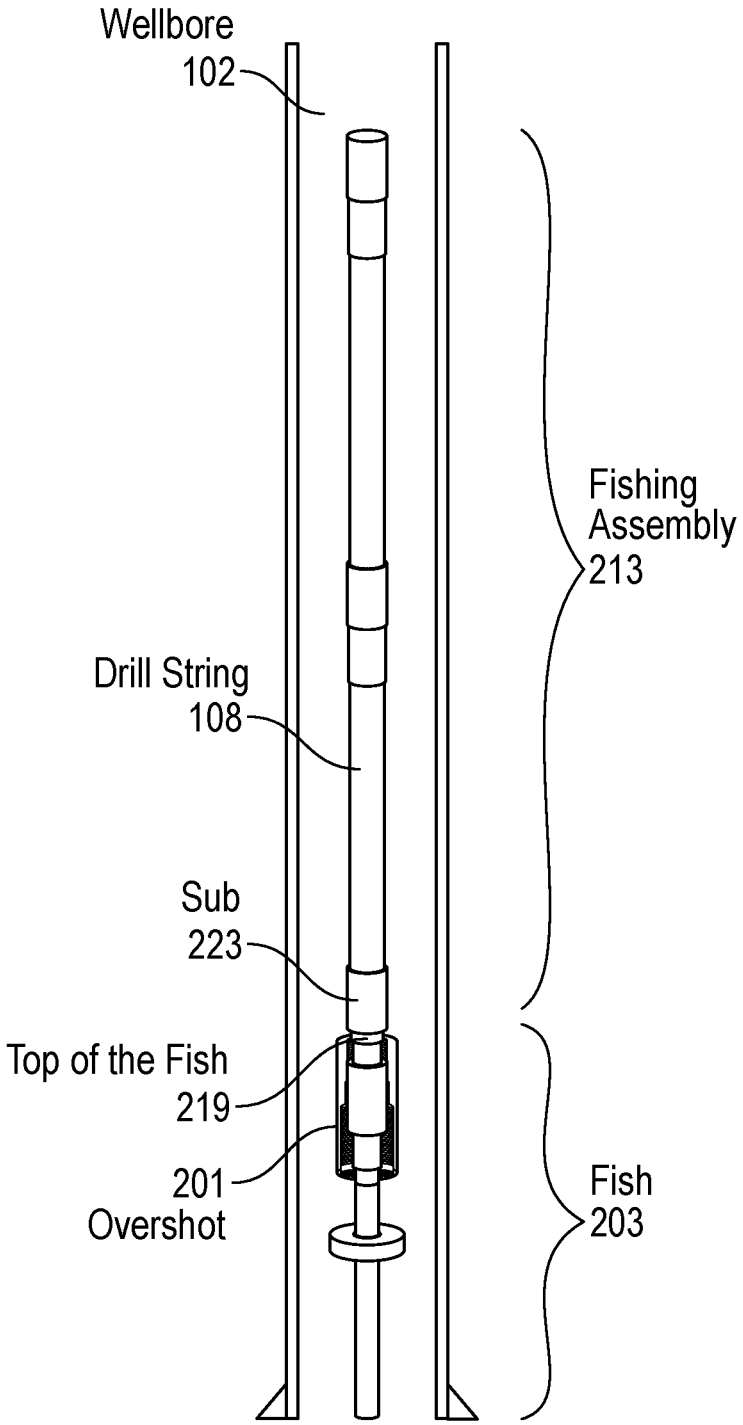

FIGS. 6 and 7 show diagrams depicting the operational sequence of the system in accordance with one or more embodiments. FIG. 6 depicts the fishing assembly (213) lowering the overshot (201) toward a fish (203). The drill pipe (109) of the fishing assembly (213) and overshot (201) are connected by the sub (223) of the fishing assembly (213). An upper end of the sub (223) is connected to the drill string (108) and a lower end of the sub (223) is connected to the overshot (201). The sub (223) is employed since a lower opening of the drill string (108) is far larger than the threaded connection (211) of the first catch (205) of the overshot (201). When connected, the drill string (108), the sub (223), and the overshot (201) are coaxial about a central axis (239).

Disposed downhole is a fish (203). The fish (203) may be from a previous drilling operation such as the drill bit (112), a portion of the drill string (108), or another piece of equipment familiar to a person skilled in the art. If the diameter of the top of the fish (219) is known, only one additional catch (207) with an internal diameter similar to the diameter of the top of the fish (219) is required to be attached to the first catch (205). However, if the diameter of the top of the fish (219) is not known, then attaching multiple additional catches (207) may be required in order to remove the fish (203) in one fishing trip. There is no limit to the number of additional catches (207) that can be employed to make up the overshot (201).

FIG. 7 depicts the overshot (201) swallowing the fish (203). The fish (203) enters the overshot (201) through the bottom opening (215) of the lowest attached additional catch (207). The fish (203) may only fit the lowest additional catch (207) before being prevented from travelling any higher within the tapered interior of the overshot (201). However, if the diameter of the fish (203) is smaller than the internal diameter of the next additional catch (207), the fish (203) passes through the top protrusion (233) of the lowest additional catch (207) and enters the next additional catch (207) through its bottom opening (215) as the overshot (201) and fishing assembly (213) lower in the wellbore (102). Once the fish (203) is prevented from travelling any further in the overshot (201) because it cannot fit through the top protrusion (233) of the next additional catch (207), the fishing assembly (213) will rotate the overshot (201), thereby engaging the spiral grapple (217) of the additional catch (207) containing the top of the fish (219) and securing the fish (203) within the overshot (201).

Figure 8:
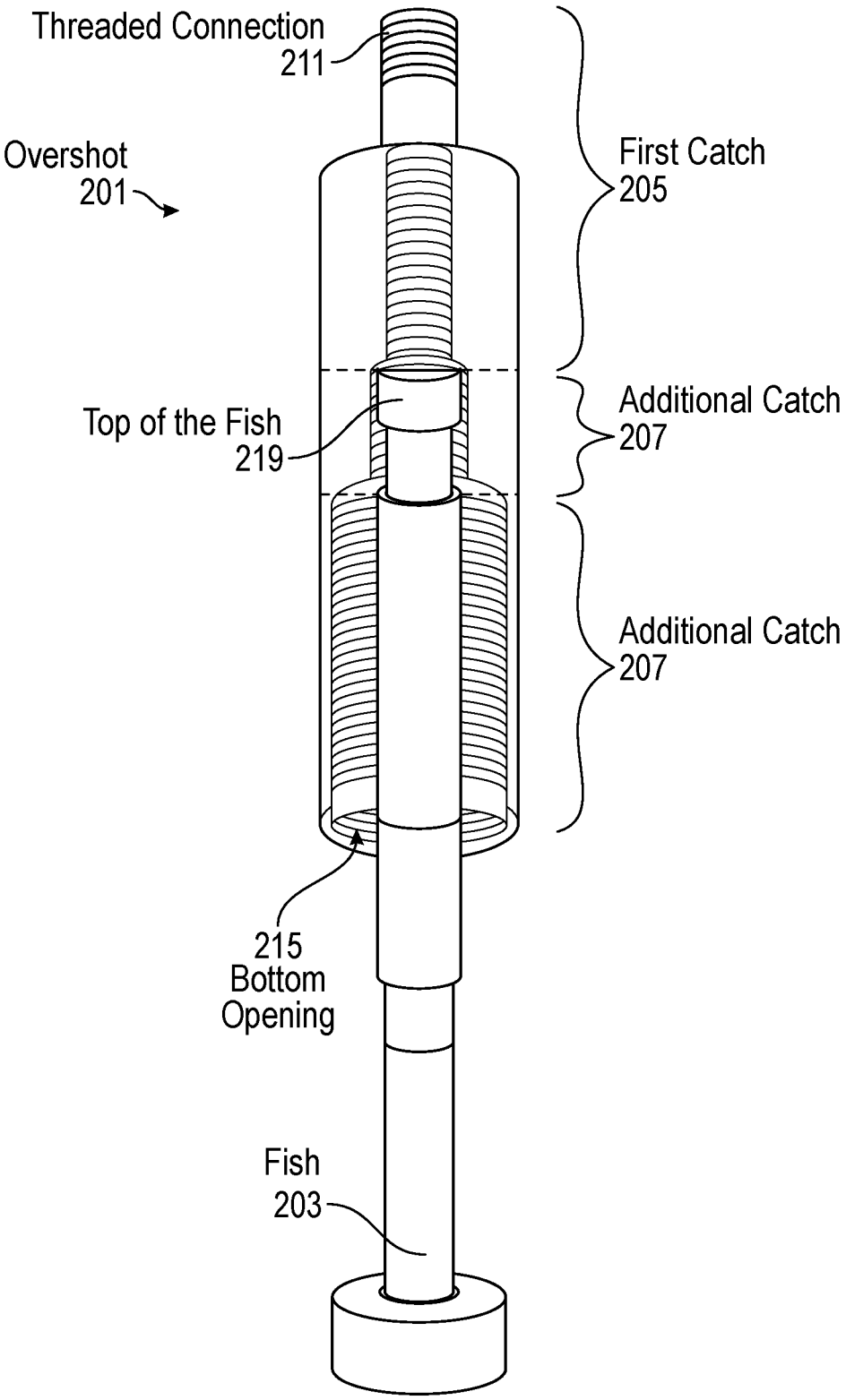
FIG. 8 shows a cross-sectional view of a fish within an overshot in accordance with one or more embodiments of the present disclosure.

FIG. 8 shows a cross-sectional view of a fish (203) within an overshot (201) in accordance with one or more embodiments of the present disclosure. As the overshot (201) is lowered over the fish (203), it passes through the additional catches (207) with internal diameters greater than the diameter of the top of the fish (219). The fishing assembly (213) will stop lowering the overshot (201) once the top of the fish (219) cannot pass any further through the overshot (201) because the internal diameter of the next additional catch (207) or first catch (205) is smaller than the diameter of the top of the fish (219), thereby preventing the fish (203) from entering the next additional catch (207) or first catch (205). While passing through the additional catches (207) with internal diameters much great than the diameter of the fish (203), the fish (203) does not interact with the spiral grapple (217) as the two are not in contact. However, as the internal diameters of the additional catches (207) decrease, the spiral grapple (217) and top of the fish (219) come into contact. The spiral grapple (217) expands outwardly as the fish (203) moves upwards in the overshot (201), allowing the fish (203) to pass through additional catches (207). When the fish (203) is prevented from travelling further upwards in the overshot (201), the top of the fish (219) and the spiral grapple (217) are in contact. Therefore, when the fishing assembly (213) rotates, the spiral grapple (217) is able to engage the top of the fish (219), thereby securing the fish (203) within the overshot (201) subsequent to the upward pull force being applied.

Figure 9:
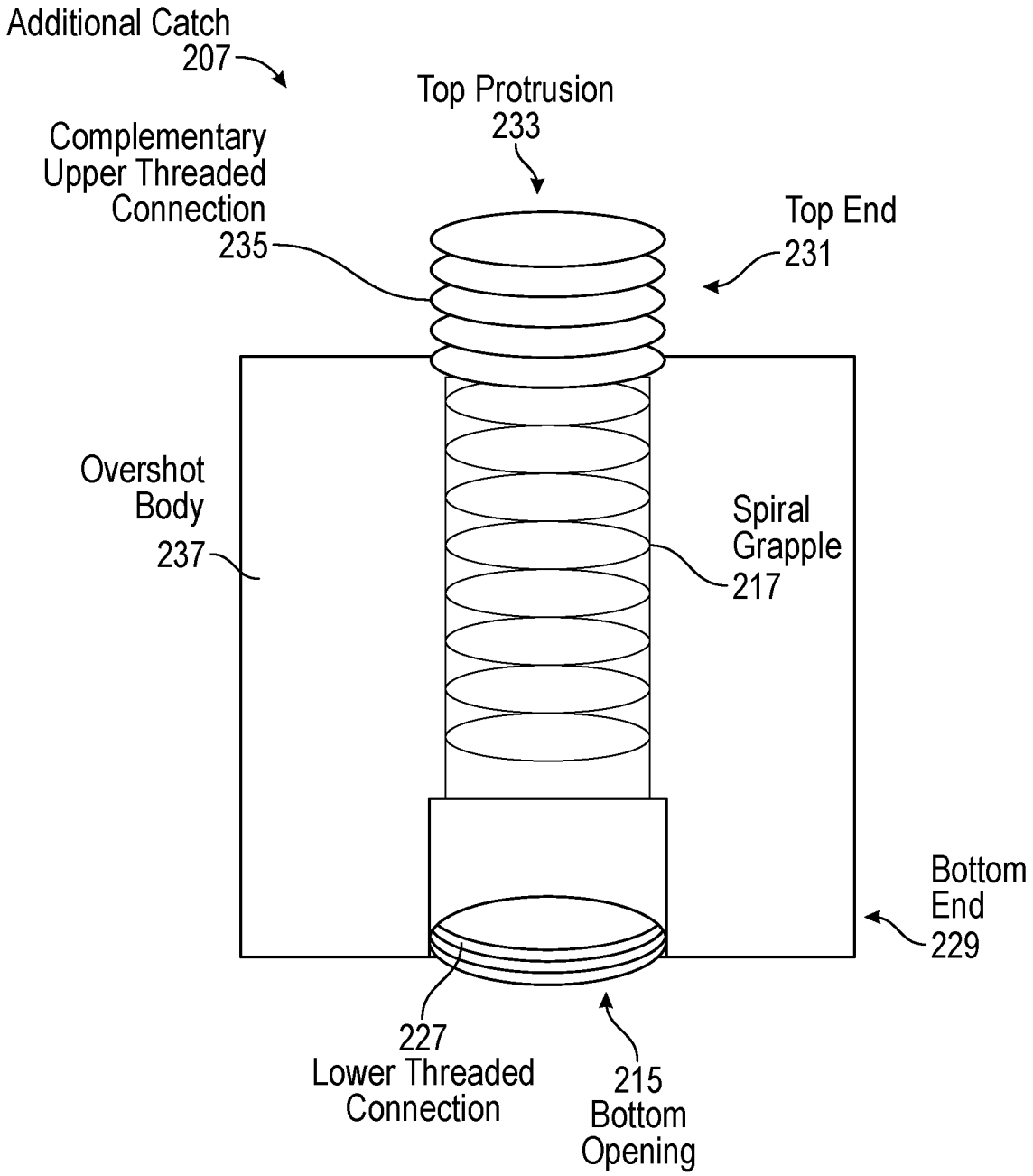
FIG. 9 shows a cross-sectional view of an overshot in accordance with one or more embodiments of the present disclosure.

FIG. 9 depicts another embodiment of an additional catch (207). In this embodiment, at a top end (231) of this additional catch (207) is a top protrusion (233) and a complementary upper threaded connection (235) that are similar in size to the internal diameter of the catch. At the bottom end (229) of the additional catch (207) is a bottom opening (215) and a lower threaded connection (227). The lower threaded connection (227) of this additional catch (207) is slightly larger than the complementary upper threaded connection (235) of this additional catch (207). In this way, the lower threaded connection (227) of this additional catch (207) only connects only to the complementary upper threaded connection (235) of the additional catch (207) with an internal diameter next in size. In this embodiment, additional catches (207) can only be connected in sequence, thereby preventing the connection of additional catches (207) out of sequence.

Figure 10:
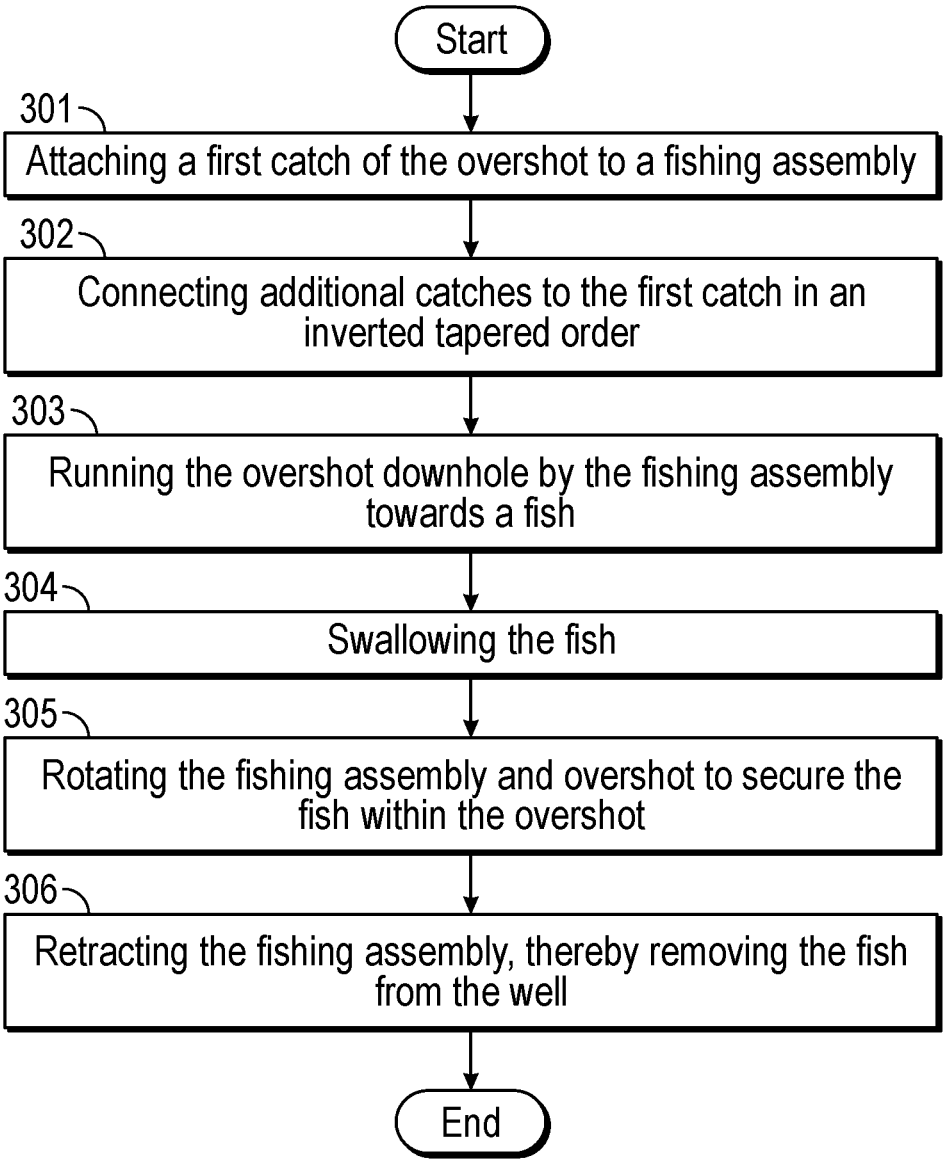
FIG. 10 shows a flowchart of a method in accordance with one or more embodiments of the present disclosure.

FIG. 10 depicts a flowchart showing a method of removing the fish (203) from the wellbore (102). While the various flowchart blocks in FIG. 10 are presented and described sequentially, one of ordinary skill in the art will appreciate that some or all of the blocks may be executed in different orders, may be combined or omitted, and some or all of the blocks may be executed in parallel. Furthermore, the blocks may be performed actively or passively.

In block 301, the first catch (205) of the overshot (201) is connected to the fishing assembly (213) by attaching the threaded connection (211) of the first catch (205) to the lower end of the sub (223). This is completed prior to the overshot (201) being lowered into the wellbore (102) towards the fish (203).

In block 302, additional catches (207) are attached to the first catch (205) of the overshot (201) in a tapered order, thereby maximizing the portability of the overshot (201). In one or more embodiments, the number of additional catches that are attached to the first catch in block 302 may depend on the dimensions of the fish being removed from the wellbore. For example, if the dimensions of the fish (203) are known, then only one additional catch (207) may be necessary to remove the fish (203) from the wellbore (102). If the dimensions of the fish (203) are not known, then several additional catches (207) may be connected to ensure only one fishing trip is made downhole.

If more than one additional catches (207) are required, the complementary upper threaded connection (235) of the additional catch (207) with the internal diameter closest in size to the internal diameter of the first catch (205) is connected to the lower threaded connection (227) of the first catch (205). Each additional catch (207) added to the overshot (201) is attached by connecting its complementary upper threaded connection (235) to the lower threaded connection (227) of the previously installed additional catch (207).

In block 303, the overshot (201) is run downhole towards the fish (203) by the fishing assembly (213). As the overshot (201) approaches the fish (203), the approach speed of the overshot (201) and fishing assembly (213) slows down so that a collision does not occur between the overshot (201) and the fish (203). Specifically, in one or more embodiments, an operator or the control system (199) on the surface monitors the distance between the overshot (201) and the fish (203) and controls the speed of approach of the overshot by regulating the drawworks (126) based on the distance information.

In block 304, the overshot (201) swallows the fish (203). The fish (203) enters the overshot (201) through the bottom opening (215) of the lowest additional catch (207) or through the opening (225) of the first catch (205) if no additional catch (207) is attached. The fish (203) continues to pass through each additional catch (207) as the overshot (201) is lowered until the internal diameter of an additional catch (207) or the first catch is smaller than the diameter of the fish (203).

At this stage, the fish (203) cannot pass through anymore additional catches (207) because its diameter is greater than the internal diameter of the next additional catch (207) (block 305). The fishing assembly (213) then rotates the overshot (201), thereby engaging the spiral grapples (217) of the overshot (201). A pull load is subsequently applied by the fishing assembly (213), and the grapple bites into the fish (203) forming a secure grip.

In block 306, the fishing assembly (213) retracts towards the surface, thereby raising both the overshot (201) and the fish (203). The fishing assembly (213) travels upwards with the fish (203) secured in the overshot (201) until the surface is reached. The fish (203) is then removed from the overshot (201) and the wellbore (102).

Accordingly, the aforementioned embodiments as disclosed relate to devices and methods useful for removing a fish (203) from a wellbore (102) in a single fishing trip, even when the specific dimensions or geometry of the fish (203) are unknown. The disclosed system for and methods of removing a fish (203) from a wellbore (102) advantageously eliminates both the need of multiple fishing runs and the need of selecting the proper catch size by trial and error. This benefit, in turn, advantageously increases the rate of success and reduces additional rig time and associated costs.

Although only a few embodiments of the invention have been described in detail above, those skilled in the art will readily appreciate that many modifications are possible in the example embodiments without materially departing from this invention. Accordingly, all such modifications are intended to be included within the scope of this disclosure as defined in the following claims.

What is claimed is:

1. An overshot for removing a fish from a wellbore, the overshot comprising:

a first catch configured to attach to a fishing assembly, the first catch comprising:

a threaded connection disposed at a first end of the first catch, configured to attach to the fishing assembly; and an opening disposed at a second end of the first catch, configured to swallow the fish;

one or more additional catches configured to be connected, in sequence, to the first catch, each of the one or more additional catches comprising:

a bottom opening disposed at a bottom end of each of the one or more additional catches, configured to swallow the fish and connect to an additional catch; and a top protrusion disposed at a top end of each of the one or more additional catches, configured to connect to the opening of the first catch or to the bottom opening of an additional catch;

wherein each catch of the one or more additional catches comprises a different internal diameter from other catches of the one or more additional catches;

wherein the one or more additional catches are configured to be connected, in order, according to their respective internal diameters;

wherein the bottom opening of each of the one or more additional catches comprises a lower threaded connection configured to be threaded together with a complementary upper threaded connection of the top protrusion of an additional catch;

wherein the lower threaded connection is disposed on an interior of the one or more additional catches and the complementary upper threaded connection is disposed on an exterior of the top protrusion of the one or more additional catches; and wherein the overshot is configured to attach to a top of the fish.

2. The overshot according to claim 1, wherein an interior of the first catch and an interior of each of the one or more additional catches comprises a spiral grapple.

3. The overshot according to claim 1, wherein the one or more additional catches are each configured with an external diameter that is the same as an external diameter of the first catch.

4. The overshot according to claim 1, wherein the fishing assembly further comprises:

a drill string configured to lower and raise the overshot in the wellbore; and a sub configured to connect the overshot to the drill string.

5. The overshot according to claim 4, wherein the drill string is connected to an upper end of the sub, and the first catch is connected to a lower end of the sub.

6. The overshot according to claim 5, wherein the sub, the first catch, and the one or more additional catches are coaxial about a central axis.

7. A method for removing a fish from a wellbore with an overshot, the method comprising:

attaching a first catch of the overshot to a fishing assembly, the first catch comprising:

a threaded connection disposed at a first end of the first catch, configured to attach to the fishing assembly; and an opening disposed at a second end of the first catch, configured to swallow the fish;

connecting one or more additional catches of the overshot to the first catch in sequential order according to their respective internal diameters, each of the one or more additional catches comprising:

a bottom opening disposed at a bottom end of each of the one or more additional catches, configured to swallow the fish and connect to an additional catch; and a top protrusion disposed at a top end of each of the one or more additional catches, configured to connect to the opening of the first catch or to the bottom opening of an additional catch;

attaching the overshot to a top of the fish;

wherein each catch of the one or more additional catches comprises a different internal diameter from other catches of the one or more additional catches;

wherein the bottom opening of each of the one or more additional catches comprises a lower threaded connection configured to be threaded together with a complementary upper threaded connection of the top protrusion of an additional catch; and wherein the lower threaded connection is disposed on an interior of the one or more additional catches and the complementary upper threaded connection is disposed on an exterior of the top protrusion of the one or more additional catches.

8. The method according to claim 7, wherein connecting one or more additional catches to the first catch is performed prior to lowering the overshot downhole.

9. The method according to claim 7, further comprising swallowing and securing the fish with a spiral grapple disposed in an interior of the overshot.

10. The method according to claim 9, wherein swallowing the fish comprises lowering the overshot over the top of the fish, with interference, such that the overshot frictionally engages the fish.

11. The method according to claim 10, wherein lowering the overshot over the top of the fish comprises moving the fish through the one or more additional catches until an internal diameter of the one or more additional catches is smaller than the top of the fish, thereby preventing the fish from moving further in the overshot.

12. The method according to claim 11, further comprising rotating the overshot over the fish to secure the fish within the overshot.

13. The method according to claim 7, further comprising slowing down a speed of approach of the overshot prior to the overshot swallowing the fish by regulating a drawworks, wherein the drawworks lowers the fishing assembly.

* * * * *